US009510713B2

(12) United States Patent
Farris, II

(10) Patent No.: US 9,510,713 B2
(45) Date of Patent: Dec. 6, 2016

(54) METHODS FOR SEWING T-POCKET TOWELS

(71) Applicant: Joe Thomas Farris, II, Lantana, TX (US)

(72) Inventor: Joe Thomas Farris, II, Lantana, TX (US)

( * ) Notice: Subject to any disclaimer, the term of this patent is extended or adjusted under 35 U.S.C. 154(b) by 96 days.

(21) Appl. No.: 14/467,337

(22) Filed: Aug. 25, 2014

(65) Prior Publication Data

US 2016/0051097 A1 Feb. 25, 2016

(51) Int. Cl.
*A47K 10/02* (2006.01)
*A47C 31/11* (2006.01)

(52) U.S. Cl.
CPC ..... *A47K 10/02* (2013.01); *A47C 31/11* (2013.01)

(58) Field of Classification Search
USPC ..... 297/228.1, 228.11, 228.12, 228.13, 220,297/229
See application file for complete search history.

(56) References Cited

U.S. PATENT DOCUMENTS

D117,521 S * 11/1939 Freidman ..... D2/719
2,441,745 A * 5/1948 Benamy ..... A41B 13/06 15/227
3,111,677 A * 11/1963 Artzt ..... A41B 13/00 2/69.5
3,559,874 A * 2/1971 Titchenal ..... B65B 9/093 229/69
4,342,278 A * 8/1982 Horan ..... B63B 7/08 114/345
4,477,930 A * 10/1984 Totten ..... A61F 2/2409 623/2.15
4,826,011 A * 5/1989 Jud ..... B65D 85/60 206/484
4,892,744 A * 1/1990 Ylvisaker ..... B65D 81/3469 383/100
5,072,467 A 12/1991 Hunt
5,147,703 A * 9/1992 Provost ..... A47K 10/02 15/209.1
5,316,337 A * 5/1994 Yamaji ..... D05B 39/00 280/728.1
5,806,925 A * 9/1998 Hanley ..... A47C 31/113 297/219.1
6,046,443 A * 4/2000 Ackerman ..... 219/727
6,156,410 A * 12/2000 Bassler ..... A41B 13/06 428/192
6,192,536 B1 2/2001 Connors
6,226,964 B1 * 5/2001 Vettorato ..... B31B 29/00 383/94

(Continued)

*Primary Examiner* — David E Allred
(74) *Attorney, Agent, or Firm* — Elizabeth Philip Dahm; Kelly J. Kubasta; Ferguson Braswell & Fraser, PC

(57) ABSTRACT

The present invention includes a method to sew a "T" shaped pocket into a towel to orient, support and secure a towel draped over a seat back or frame structure which is an capable being accessibly and removably coupled to suitable objects, such as car seats and other seating having back rests or frames used to display advertising messages or items placed on display resting in the T-pocket. The T-pocket component may include a first end and a longer second end, the longer second end employed to provide a level of protection for the underlying seat and comfort to the seated person, but also allow the person to dry himself and maintain warmth.

17 Claims, 6 Drawing Sheets

(56) References Cited

U.S. PATENT DOCUMENTS

| | | | | |
|---|---|---|---|---|
| 6,297,943 | B1 * | 10/2001 | Carson | A61N 1/3754 29/25.42 |
| 6,389,597 | B1 * | 5/2002 | Henegan | A41B 13/06 2/69.5 |
| 7,000,984 | B1 | 2/2006 | Ward | |
| D560,330 | S * | 1/2008 | Williams | D2/825 |
| D617,533 | S * | 6/2010 | Douglas | D2/825 |
| D632,058 | S * | 2/2011 | Pritchett | D2/823 |
| D677,860 | S * | 3/2013 | Kim | D2/823 |
| 2004/0173492 | A1 * | 9/2004 | Kane, Jr. | B65B 9/067 206/494 |
| 2004/0244338 | A1 * | 12/2004 | Nievergeld | B29C 65/18 53/451 |
| 2005/0284775 | A1 * | 12/2005 | McLaughlin | A01F 25/14 206/83.5 |
| 2008/0008404 | A1 * | 1/2008 | Brauer | B65D 31/10 383/61.1 |
| 2008/0267541 | A1 * | 10/2008 | Daelmans | B65B 9/20 383/207 |
| 2009/0079166 | A1 * | 3/2009 | Urushibata | B60R 21/235 280/728.1 |
| 2010/0210438 | A1 * | 8/2010 | Nakagawa | B65B 9/2028 493/186 |
| 2011/0033133 | A1 * | 2/2011 | Kujat | B65D 31/10 383/20 |
| 2012/0125521 | A1 * | 5/2012 | Dersch | B29C 66/81431 156/73.1 |
| 2012/0132198 | A1 * | 5/2012 | Hausmann | A61M 11/06 128/200.14 |
| 2012/0245010 | A1 * | 9/2012 | Drut | B29C 65/08 493/243 |
| 2013/0111645 | A1 | 5/2013 | Dokhanian | |

* cited by examiner

METHODS FOR SEWING T-POCKET TOWELS

CROSS-REFERENCE TO RELATED APPLICATION 35 USC §119(e)

Not Applicable

FIELD OF INVENTION

This invention relates to sewing patterns to form specifically shaped T-pocket towels, and in particular, T-pockets which provide for orientation, stability, support and other useful benefits to placing, hanging or wearing a towel on an object or a person.

BACKGROUND OF INVENTION

Towels are commonly found in various settings where people work, play and entertain. Towels are used to protect objects from dirt, moisture, cold and wind; used to hide or conceal items or persons; used to dry objects or persons; and, are also used to demonstrate affinity, loyalty or support for teams, brands or products by the color, printed artwork applied or by the shape of the towel.

A towel can be flat. It can also be square, round, rectangle or any other shape. Handles, rings or loops can be attached. Towels can be made of thick and plush fabric, thin and sheer fabric and just about any other combination of known materials.

U.S. Pub. No.: US 2013/0111645 A1 "ATHLETIC APPAREL" provides an article of athletic apparel comprised of different adjacent materials with one of these materials substantially more hydrophilic than the first material. In the present invention, materials are joined using the sewing method described herein yet the types of materials used for the towel will not affect the usefulness of the resulting T-pocket described herein.

U.S. Pat. No. 7,000,984 describes a "BEACH TOWEL CAR SEAT COVER" as an apparatus for a seat cover having a moisture impermeable material and a an absorbent material with strategically placed straps providing means for securing the seat cover to a seat. The type of material and the assembly of these materials will not affect the usefulness of the resulting T-pocket described herein; which, by the design of the T-pocket renders the need for straps obsolete for the purpose of stabilizing the towel when draped over a car seat.

Towels are difficult to secure to objects. Typically, one can use a belt, rope or another towel to tie a towel to an object. As described above, straps have also been used to secure the position of a towel. The towel can also be wrapped or folded upon itself using tension to hold it in place. Or, a towel can be affixed to an object using snaps, buttons or other fasteners affixed to the object to which the towel is secured. The T-Pocket described herein effectively renders these other fastening mechanisms obsolete for the purpose of draping the towel over an object.

U.S. Pat. No. 6,192,536 describes a "WIND RESISTANT BEACH TOWEL". A beach towel made of ordinary, machine washable fabric, together with a plurality of pockets, which may be filled with sand or other material to weigh down the towel is provided. The T-pocket described herein is not a substitute or alternative to the pockets described therein; nor does the T-pocket address the concept of "weighing" down the towel to keep it in place. To the contrary, the T-pocket is s new design which provides a cavity to encompass the shape of an object such as a car seat for retention of position in such situations as described therein.

For example, a "BEACH TOWEL WITH POCKETS" is presented in U.S. Pat. No. 5,072,467. Beach towel has envelopes attached there to so as to create closeable envelopes on the towel and pockets behind the envelope. The envelopes and/or pockets can be used for storing needed items such as sunscreen lotion, clothing items, or entertainment items such as a book or radio. The envelopes and/or pockets can alternatively be used as a receptacle for sand in order to hold down the beach towel and form a pillow. The T-pocket described herein is not a tainer pocket as described therein. While the T-Pocket does form a "bucket" or "bowl" when draped over a frame assembly in which objects can be placed for display, storage and collection, the "bucket", "bowl" or "cavity" that is described more below has uses which are more suited to situations like easily displaying candy, coupons, trinkets and the like.

SUMMARY OF INVENTION

The following presents a simplified summary in order to provide a basic understanding of some aspects of the disclosed invention. This summary is not an extensive overview, and it is not intended to identify key/critical elements or to delineate the scope thereof. Its sole purpose is to present some concepts in a simplified form as a prelude to the more detailed description that is presented later.

To resolve the problems mentioned above, an object of the present invention is to provide a specific method for sewing the opposing edges of a typical towel in the form of a "T" to create a pocket or cavity. The particular technique creates perpendicular seams that form the "T" shape, which when sewn, forms a pocket on the sewn end of the towel.

The sewing technique is preferred to alternatives such as using zippers, loops and rings, snaps or eyelets and string. Sewing eliminates the use of metal or plastic fittings that may scratch, tear or mark fabrics or materials such as wood finishes or leather coverings. Sewing the seams also eliminates some noise and the potential for scratching the finish in washing machines or dryers from the metal or plastics fittings. Sewing also eliminates the potential for burning the skin which may result from using the towel outdoors in sunlight for extended hours, whereby metal or plastic fittings could get hot and burn the skin when touched.

It is another object of the present invention to provide a pocket which will support the towel when the towel is draped over an object, thus allowing the towel to remain in position. Such objects can include car seats, lounge chairs, or any similar back rest. When the towel is draped over a frame structure with a void underneath the horizontal plane defined by the interior space surrounded by the frame members, the pocket will droop within the void space creating a "pocket" or "cavity" in which items can be placed for display or containment. These applications by the user have particular benefit which is found in the present invention.

It is yet another object of the present invention to provide stability in position of the towel when draped over a back rest or supporting frame whereby the long face of the towel is suspended allowing the user to apply images or words to the fabric which are displayed as a result of the towel positioning facing outward. This is particularly important for users that want to advertise a brand or message using the towel when draped over a chair, car seat or other similar back rest structure.

The present invention comprises a sewing technique which attaches the opposing sides of one end of a towel to form a "T" pattern, which in turn forms a pocket. The manner in which the edges are attached in the "T" shape of the differ from a single seam "hood" formed by sewing the edges of the end of a towel to each other from the outer most edge to the mid-point of the edge of a towel. In the present invention, the seam is started from the outer most corners placed back to back of the edge of the towel and sewn a length less than to the mid-point. For the remaining span, the remaining span is sewn to the opposing side of the same edge segment. This differentiation forms the "T" shape which in turn forms the seam along the top of the pocket which provides for stability, orientation and support not found in other "hood" or cavity designs.

The towel which is made of fabric material, for instance machine washable terry cloth provides adequate support to sew a seam to form the "T" pocket. The materials used in the fabric and thread are durable, easily manipulated and coated or formed of materials that reduce the likelihood of causing damage to the objects or persons over which the towel is draped. The materials selected to form the towel may also include properties which provide for the application of ink, stencils or other applied markings which allow the towel to be positioned as a form of advertising when draped over a chair, seat, frame or worn over the head or shoulders of a person.

Embodiments of the present disclosure generally may provide seat-covering systems that not only provide a level of protection for the underlying seat and comfort to the seated person, but also allow the person to dry himself and maintain warmth.

In another embodiment, the present disclosure may provide a seat-covering system comprising a hood-like component to accessibly and removably couple to a seat. The hood component may comprise a cape-type feature.

Finally, the present invention provides carry, storage and transport of the towel in a simple and efficient way: The first the "T" shape of pocket provides a default orientation when the towel is spread flat. Using this orientation, a person can fold the long edges of the towel according to the span of the "T" pocket and then continue folding intermediate sections of the towel starting from the lower unsewn edge of the towel towards the sewn edge of the towel and once folded, tuck the towel underneath the T-pocket for storage. Once complete folded, the T-Pocket retains the shape of the folded towel for display, stacking multiple towel side-by-side or vertically in a stack. These alternate applications provides users more convenient alternatives when using the towel.

Still other objects of the present invention will become readily apparent to those skilled in this art from the following description wherein there is shown and described the embodiments of this invention, simply by way of illustration of the best modes suited to carry out the invention. As it will be realized, the invention is capable of other different embodiments and its several details are capable of modifications in various obvious aspects all without departing from the scope of the invention. Accordingly, the drawing and descriptions will be regarded as illustrative in nature and not as restrictive.

BRIEF DESCRIPTION OF THE DRAWINGS

Various exemplary embodiments of this invention will be described in detail, wherein like reference numerals refer to identical or similar components, with reference to the following figures, wherein.

DETAILED DESCRIPTION

The claimed subject matter is now described with reference to the drawings. In the following description, for purposes of explanation, numerous specific details are set forth in order to provide a thorough understanding of the claimed subject matter. It may be evident; however, that the claimed subject matter may be practiced with or without any combination of these specific details, without departing from the spirit and scope of this invention and the claims.

Embodiments of the present disclosure generally may provide seat-covering systems that not only provide a level of protection for the underlying seat and comfort to the seated person, but also allow the person to dry himself and maintain warmth.

Figure 2:
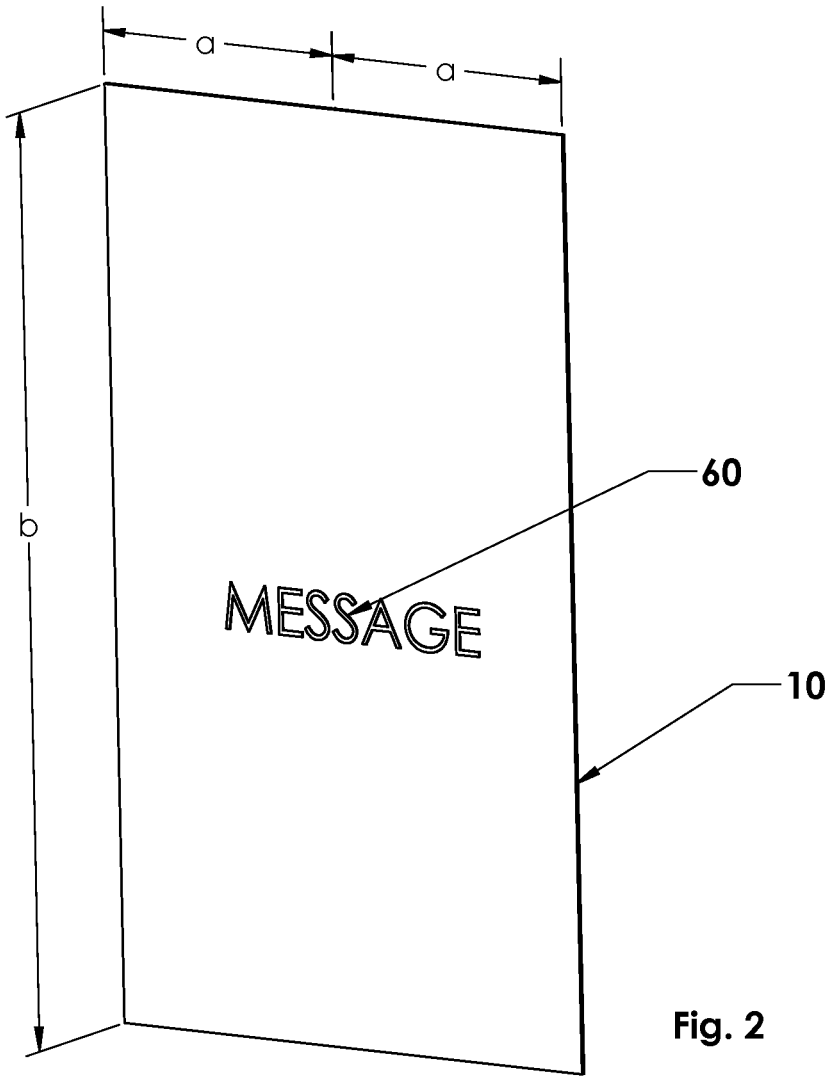
FIG. 2 is an exemplary illustration of flat towel from which the method for sewing the T-pocket is applied in accordance with the embodiments of the present disclosure.

FIG. 2 depicts a preformed a typical rectangular towel system 10. In one embodiment, system 10 may have a width (w) measuring about 40 inches represented by two segements of measure "a" and a length (I) measuring about 70 inches represented by one measure "b". In such embodiments, the width (2×a) and length (b) may be varied. In those embodiments, the T-pocket is not restricted by the variances of width (2×a) to length (b) nor is the method used to form the "T" determined by the length (b) measurement.

Figure 3:
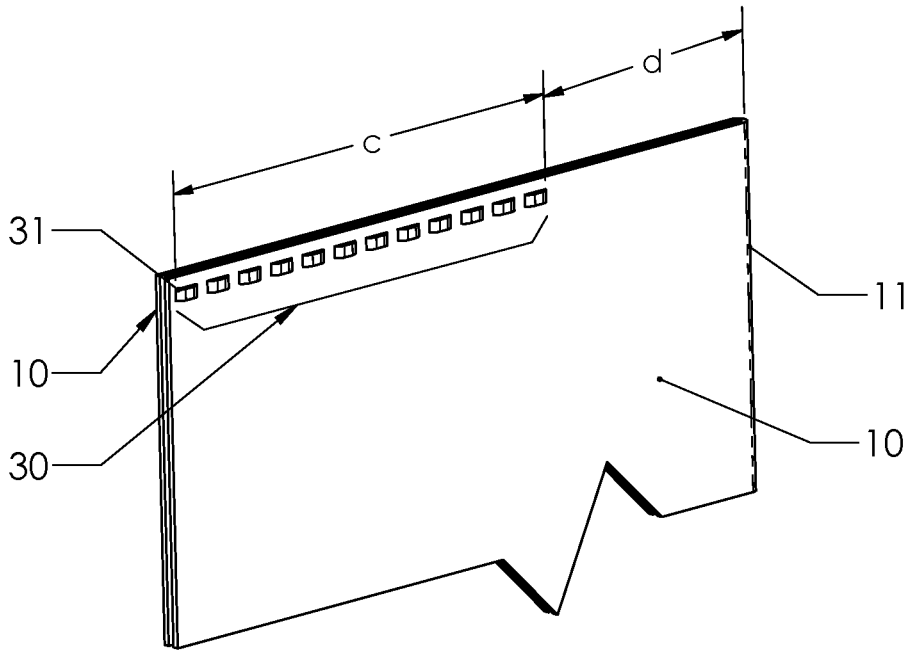
FIG. 3 is an perspective view of the towel in FIG. 2 folded vertically exposing the back face of the towel and the horizontal edge seam which forms the base of the T-pocket of FIG. 1 in accordance with embodiments of the present disclosure.

FIG. 3 depicts the base seam of the T-pocket. In an embodiment of the present disclosure, the base seam system 30 may be formed by folding system 10 in half along the midpoint edge shown as 11 with the front or right-side out surfaces inward and opposing each half. Individual stitches 31 are applied along the span 30 of the top edge of folded system 10. The span length is measurement (c) which is approximately two-thirds the measurement of span (a) shown in FIG. 2. The remaining span (d) is approximately one-third the measurement of span (a) shown in FIG. 2. When the seam system 30 is completed, the base seam of the T-pocket is formed.

Figure 4:
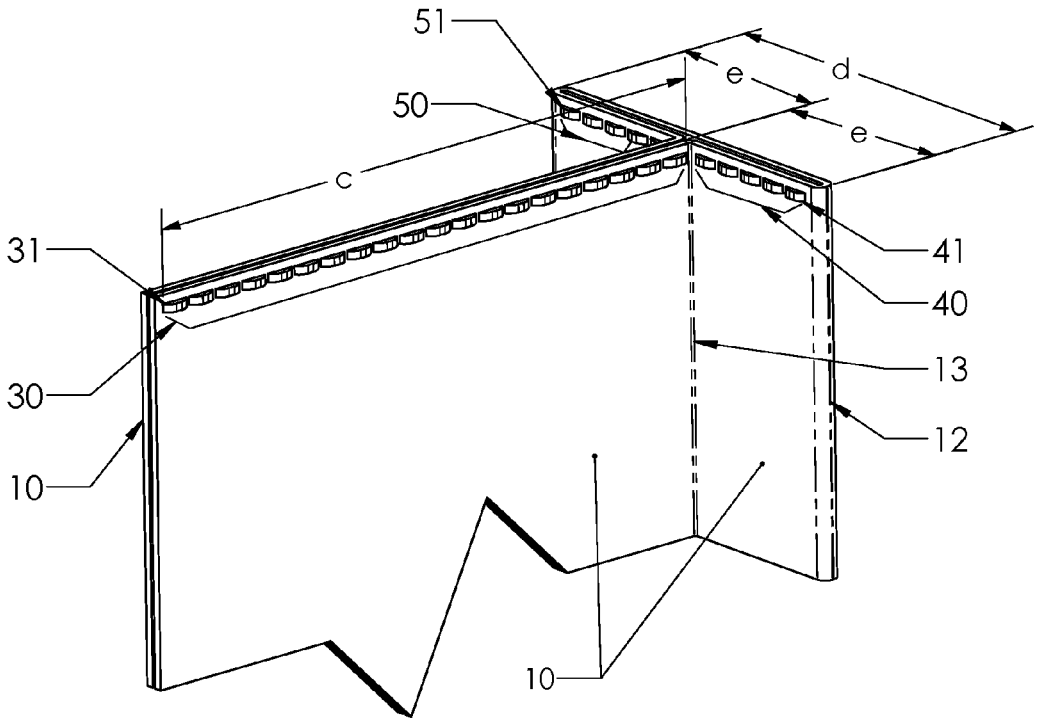
FIG. 4 provides an exemplary illustration of the sewn towel in FIG. 3 with the perpendicular edge seam which forms the top of the T-pocket of FIG. 1 in accordance with embodiments of the present disclosure.

FIG. 4 depicts the top seam of the T-pocket. In an embodiment of the present disclosure, the top seam systems 40 and 50 may be formed by folding system 10 again along the perpendicular plane to the base seam 30. Span (d) is folded in half so that the midpoint of span (d) meets the interior end point of seam 30. Individual stitches 41 and 51 are applied along the spans d left and right along the top edge of folded system 10. The span length is measurement (d) which is approximately one-third the measurement of span (a) shown in FIG. 2 and is formed with two equal left and right segments measure (e). The left and right spans (e) are approximately one-half the measurement of span (d) shown in FIG. 4 and one-sixth the measurement of span (a) shown in FIG. 2. When the seam systems 40 and 50 are completed, the top seam of the T-pocket is formed, this forms the competed T-pocket seam.

In alternative embodiments, seam 30, 40 and 50 may be formed any suitable manner, such as being bonded, glued, stapled, or any other suitable coupling method including using hook-and-loop fasteners, zippers, buckles, button, snap-button, adhesive, permanent adhesive, peel-and-stick material, male and female coupling adapters, other suitable coupling materials, or any combination thereof.

Figure 1:
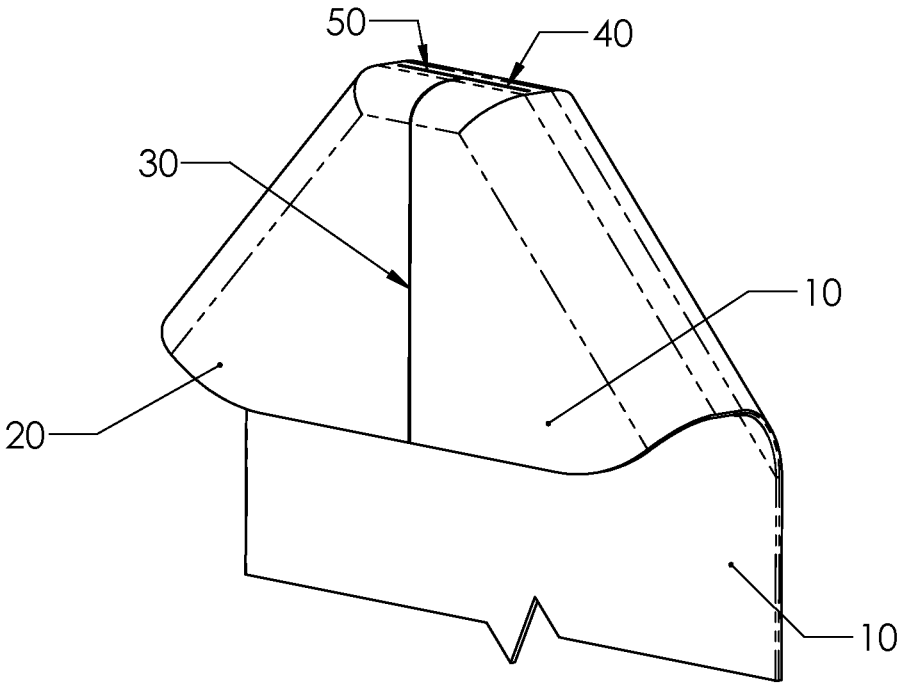
FIG. 1 is an exemplary illustration of a back view of the T-pocket in accordance with embodiments of the present disclosure.
Figure 5:
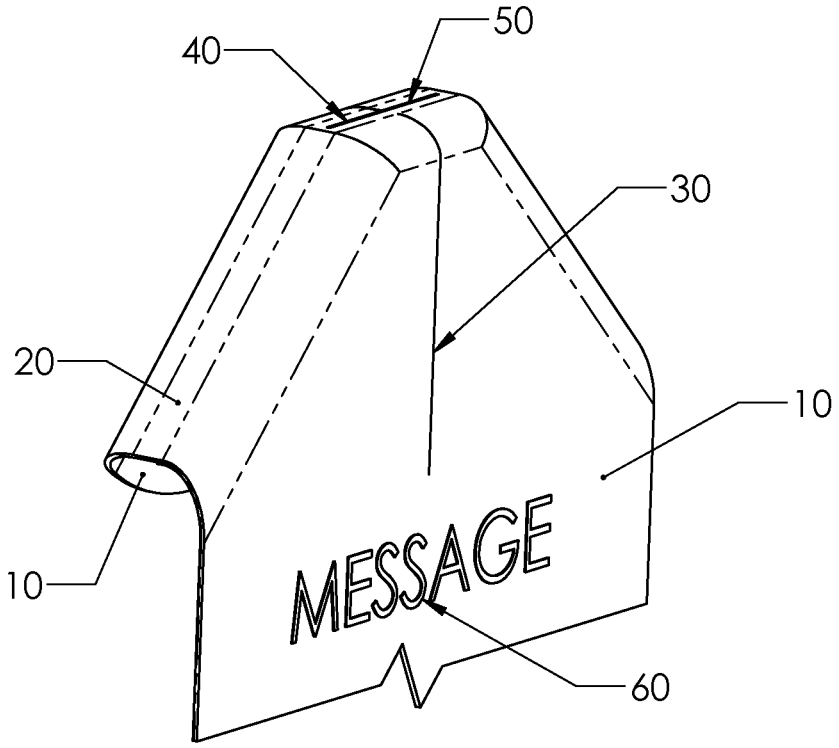
FIG. 5 provides an exemplary illustration of the sewn towel in FIG. 4 turned right-side out and forward facing opposite as shown in FIG. 1 in accordance with embodiments of the present disclosure.

FIG. 1 and FIG. 5 generally illustrate the T-pocket system 20. FIG. 1 illustrates the back face of system 20 and FIG. 5 illustrates the front face of system 20. It should be understood that system 20 shown in FIG. 1 and FIG. 5 is for illustrative purposes only and that any other suitable system or subsystem could be used in conjunction with or in lieu of system 20 according to one embodiment of the present disclosure.

System 20 may generally include hood-like component as depicted in FIGS. 1 and 5. Alternatively, system 20 may include a pocket-like component as depicted as 70 in FIG. 6.

In an embodiment of the present disclosure, hood-like component may be employed to accessibly and removably couple system 20 to an object, such as a seat. A pocket-like component may be employed to accessibly and removably couple system 70 to an object, such as a frame assembly.

In operation, hood-like component system 20 may be coupled to an object, such as a seat back, by lifting hood-like component system 20 over the seat back and then hooding the seat back with hood-like component system 20, such that first end with systems 40 and 50 engages the back of the seat back. In such an orientation, the longer second end of system 10 substantially covers the seat with system 60 displayed if applied to system 10, thereby providing a layer of protection between the seat and a seated person.

Figure 6:
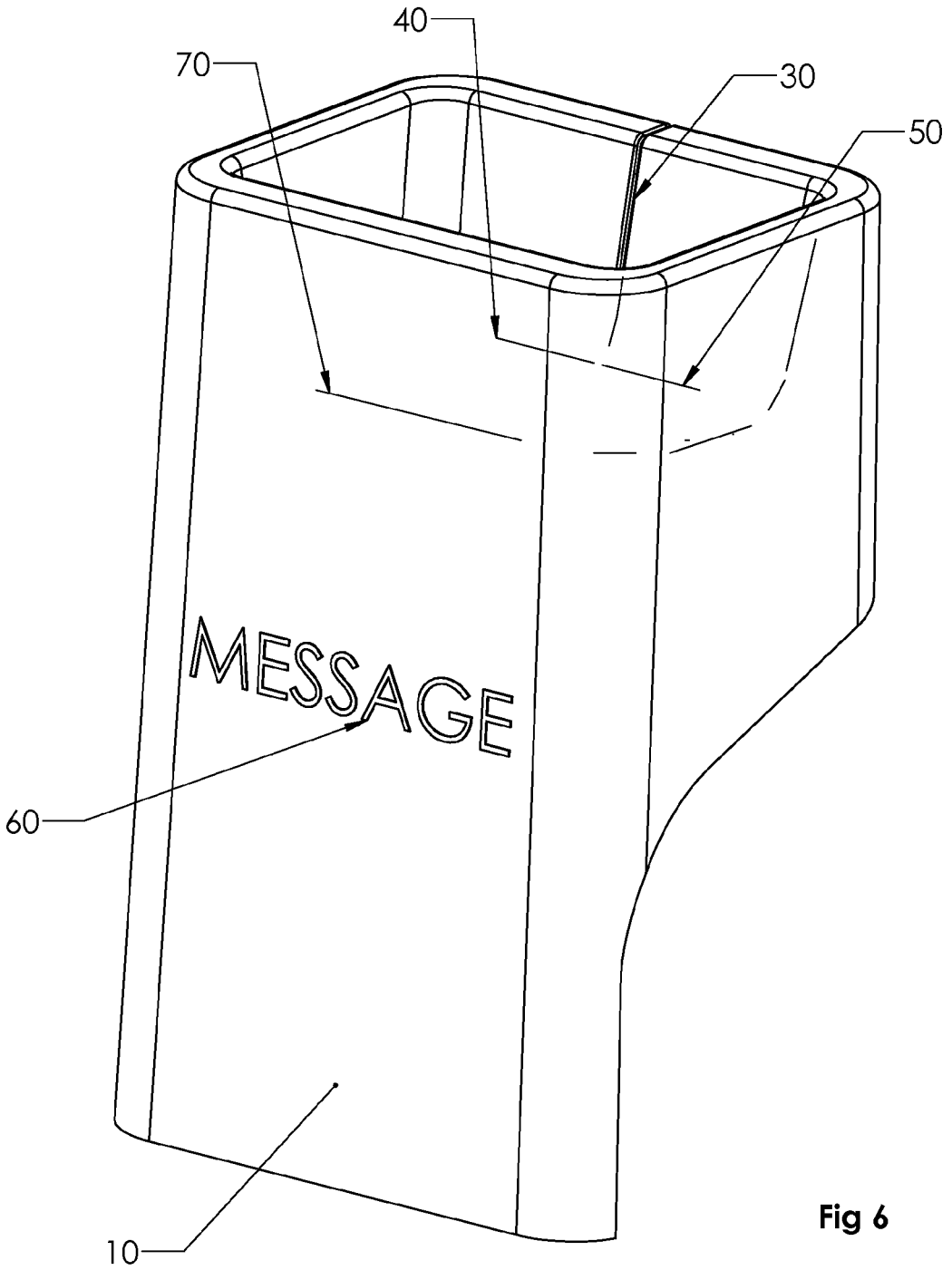
FIG. 6 is a perspective view of the completed T-pocket draped suspended in space to illustrate how the T-pocket will droop into the cavity created by the void of a frame structure for displaying the message or images applied to the front face of the towel and creating a pocket to hold items for display in accordance with the embodiments of the present disclosure.

In alternate operation shown in FIG. 6, pocket-like component system 70 which is essentially hood-like system 20, FIG. 1 inverted, may be coupled to an object, such as a frame assembly, by laying pocket-like component system 70 over the frame assembly and then allowing the system 10 sewn with the T-pocket seams 30, 40 and 50 to droop into the void formed by the frame assembly, such that first end with systems 30, 40 and 50 of system 10 engages the frame assembly. In such an orientation, the pocket-like system 70 of system 10 substantially covers the frame and forms the pocket, while the long end of system 10 is suspended from the top of the frame assembly and allowed to hang from the frame assembly with system 60 displayed if applied to system 10, thereby providing a display of system 10 along with system 60.

In one embodiment, hood-like component system 20 or pocket-like system 70 may stretch and expand so as to accommodate objects with varying size and shape. In other embodiments, hood-like component system 20 may compress and tightly secure itself around smaller objects, such as the seat back of a stadium seat. Pocket-like system 70 may stretch and become more shallow or compress and have more depth.

Once coupled with an object, hood-like component system 20 or pocket-like system 70 may remain securely in place as a result of seams 30, 40 and 50, which may allow for ample enclosure of an object within hood-like component system 20 or enclosure of an object within pocket-like system 70.

System 10 may be coupled to seats having backs, such as, for example, car seats, beach chairs, stadium seats, airplane seats, house chairs, sofa chairs, patio chairs, lounge chairs, other suitable seats, or a combination thereof. System 10 may also be coupled to frames having square, rectangle, round, conical or triangular voids such as tubes, pipes, canisters, bowls, basins, or a combination thereof.

Hood-like component system 20 or pocket-like component system 70 may also be employed to accessibly and removably couple system 10 to any other suitable object.

In one embodiment of the present disclosure, system 10 may be employed to clean water, sand, dirt, rain, mud, snow, and/or sweat off of a person, while protecting a seat or other suitable object from becoming dirtied.

In another embodiment, system 10 may be employed as a protective barrier for a seated person against a dirty chair.

In alternative embodiments, a non-seated person may employ system 10 as a hooded cape to dry and warm himself.

In alternative embodiments, system 10 may be employed as a message board as a form of advertising.

In alternative embodiments, system 10 may be employed as a display container to hold items for display, give-a-way or for sale.

Any of hood-like component system 20 or pocket-like system 70, system 10 may be made of terry cloth, terry cloth like material, towel-like material, bamboo, silver impregnated material, carbon impregnated material, other materials having natural properties, other materials having infused antimicrobial properties, cotton, polyester, cloth, canvas, jute, hemp, sisal, fiber, natural fiber, synthetic fiber, other suitable material, or any combination thereof.

In one embodiment, the exterior surface of any of hood-like component system 20, pocket-like system 70, system 10, seams 30, 40 50, and stiches 31, 41 and 51 may be embellished with different colors, patterns, camouflage patterns, patches, fabric paint, novelty items, ornamental items, stickers, removable stickers, text, logos, designs, images, other embellishments, other decorative materials, or any combination thereof to enhance or otherwise achieve a desired design.

It may be advantageous to set forth definitions of certain words and phrases used in this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

What has been described above includes examples of the claimed subject matter. It is, of course, not possible to describe every conceivable combination of components or methodologies for purposes of describing the claimed subject matter, but one of ordinary skill in the art can recognize that many further combinations and permutations of such matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

I claim:

1. A car seat protective cover comprising:

a length of fabric comprising:

a first fabric end;

a second opposing fabric end, the second opposing fabric end comprising:

a first edge length, wherein the first length comprises:

a first part;

a second part;

a third part;

a fourth part; and a fifth part;

wherein the first part and the fifth part are disposed on opposing edge ends of the second opposing fabric end, and wherein the second part is disposed between the first part and the third part, and wherein the fourth part is disposed between the third part and the fifth part;

a first seam coupling the first part and the fifth part;

a second seam coupling the second part to a first portion of the third part; and a third seam coupling the fourth part to a second portion of the third part;

a first area disposed between the first fabric end and the second fabric end; and a pocket formed by the first seam, second seam and third seam, the pocket formed between the first area and an area proximate the first seam, second seam and third seam, wherein the pocket is substantially trapezoidal.

2. The cover of claim 1 wherein the first area is disposed closer to the second fabric end than the first fabric end.

3. The cover of claim 1 wherein the length of fabric is approximately rectangular.

4. The cover of claim 1 wherein the second seam is approximately straight.

5. The cover of claim 1 wherein the second seam is approximately straight, and wherein the third seam is approximately straight.

6. The cover of claim 1 wherein the third part of the second fabric end includes a middle of the second fabric end.

7. The cover of claim 1 wherein at least one of the second seam or the third seam is disposed on a different plane than a plane generally defined by the first area when the pocket of the cover is disposed on a seat.

8. A towel comprising:

a length of fabric comprising:

a first fabric end;

a second opposing fabric end, the second opposing fabric end comprising:

a first edge length, wherein the first edge length comprises:

a first part;

a second part;

a third part;

a fourth part; and a fifth part;

wherein the first part and the fifth part are disposed on opposing edge ends of the second opposing fabric end, and wherein the second part is disposed between the first part and the third part, and wherein the fourth part is disposed between the third part and the fifth part;

a first seam coupling the first part and the fifth part;

a second seam coupling the second part to a first portion of the third part; and a third seam coupling the fourth part to a second portion of the third part;

a first area disposed between the first fabric end and the second fabric end; and a pocket formed by the first seam, second seam and third seam, the pocket formed between the first area and an area proximate the first seam, second seam and third seam, wherein the second seam and the third seam are configured to be disposed on a different plane than a plane generally defined by the first area when the pocket of the cover is disposed on a backrest.

9. The towel of claim 8 wherein the towel is capable of coupling to a seat to at least partially cover the seat.

10. The towel of claim 8 wherein the pocket is capable of stretching.

11. The towel of claim 8 wherein the pocket is substantially trapezoidal.

12. The towel of claim 8 wherein the first area is disposed closer to the second fabric end than the first fabric end.

13. The cover of claim 8 wherein the length of fabric is approximately rectangular.

14. The cover of claim 8 wherein the second seam is approximately straight.

15. A method of sewing a pocket in a towel comprising:

sewing a first seam along a first edge of the towel to couple a first edge end and a second edge end of the first stage to each other, wherein the first edge end and the second edge end are disposed on the same end of the towel;

sewing a second seam to couple together first portions of the first edge not in the first seam such that a proximal end of the second seam is disposed proximate a distal end of the first seam;

sewing a third seam to couple together second portions of the first edge not in the first seam such that a proximal end of the third seam is disposed proximate a distal end of the first seam and proximate the proximal end of the second seam;

forming a substantially trapezoidial pocket in the towel by sewing the first seam, sewing the second seam, and sewing the third seam;

wherein the first seam, second seam, and third seam form a T shape.

16. The method of claim 15 wherein the first seam extends from outer most portions of the first edge to a point less than the midpoint of the first edge.

17. The method of claim 15 wherein sewing the second seam comprises sewing the second seam such that the second seam is configured to be disposed in a different plane than a plane generally defined by the first area when the pocket is disposed over a portion of a seat; and wherein sewing the third seam comprises sewing the third seam such that the third seam is configured to be disposed in a different plane than the plane generally defined by the first area when the pocket is disposed over the portion of the seat.

* * * * *